United States Patent [19]

Graham et al.

[11] Patent Number: 4,483,327

[45] Date of Patent: Nov. 20, 1984

[54] RELAXATION MACHINE

[76] Inventors: David J. Graham; Bruce C. Lloyd, both of R.R. 2, Orillia, Ontario, Canada, L3V 6H2

[21] Appl. No.: 389,030

[22] Filed: Jun. 16, 1982

[51] Int. Cl.[3] ..... A61H 1/02

[52] U.S. Cl. ..... 128/25 R; 5/109

[58] Field of Search ..... 128/24 R, 25, 33; 272/53.1; 5/63, 83, 108, 109

[56] References Cited

U.S. PATENT DOCUMENTS

| | | | |
|---|---|---|---|
| 1,791,777 | 2/1931 | Webb | 128/33 |
| 4,175,550 | 11/1979 | Leininger et al. | 128/24 R |
| 4,194,499 | 3/1980 | Donnelly, Jr. | 128/24 R |
| 4,256,095 | 3/1981 | Graham | 128/24.1 |

*Primary Examiner*—Richard J. Apley
*Assistant Examiner*—David J. Brown
*Attorney, Agent, or Firm*—Peter R. Hammond; W. Dennis Moss

[57] ABSTRACT

A machine for relieving stress and anxiety in the absence of any electric field having a transporting device with a supportive surface adapted to carry a human body through a circular movement. A rotary drive mechanism moves the transport device along a circular path. In one embodiment the supportive surface is elongate and carries the human body in the reclining position. In this embodiment the transport device rotates in a vertical plane about a horizontal axis. In another embodiment the transport device is in the form of a chair adapted to carry a sitting human body. In the latter embodiment, the chair rotates in a horizontal plane about a vertical axis. A mechanical linkage is connected to the transport device to maintain the same directional orientation of the supportive surface as the transport device moves along the circular path. A method for relieving stress in a human body using the two forms of the machine is also taught.

3 Claims, 7 Drawing Figures

RELAXATION MACHINE

BACKGROUND OF THE INVENTION

This invention relates to machinery for relieving stress in a human and in particular to machines that relieve stress by moving the human body in a certain manner.

In my U.S. Pat. No. 4,256,095 issued Mar. 17, 1981, I disclosed an electromechanical, therapeutic apparatus for treating a human subject. In the known apparatus, the patient lies horizontally on a platform that is designed to rotate about a horizontal axis. Because of the manner in which the platform is mounted, the subject always faces in the same direction despite the rotational movement of the platform on which he is lying. Because the orientation of the subject does not change, he is not likely to become nauseated or disoriented. This known machine is provided with an AC generator, which provides a low frequency signal, connected across a pair of electrodes located at opposite ends of the platform. The body located between the electrodes is subjected to a low energy electrical field in addition to a uniformly varying physical force produced by the combined effects of gravity and the rotational movement.

According to the teachings of my U.S. Pat. No. 4,256,095, the electrical field in addition to the rotational motion is required if the subject is to obtain the benefits of a feeling of well being and relaxation. I have now discovered that in fact an electrical field is not required in many cases in order to cause the subject to relax and to relieve stresses. Machines of this type may also enhance learning abilities.

Use of a spinning chair to stimulate the development of learning abilities in learning disabled children has been known for some time. Such chairs have been used by Ohio State University in the United States. The chair is constructed in a manner similar to an ordinary secretarial chair with a supporting base and an upper chair portion adapted to rotate about a vertical axis on the base. The chair is modified so that it has a motor and drive mechanism to rotate the upper portion at a uniform rate. The problem with this type of spinning chair is that treatment can only be given for very short periods of time, generally thirty seconds, before the motion becomes unbearable. Also it can cause nausea and dizziness and is generally unsettling for the patient or subject.

SUMMARY OF THE INVENTION

According to the invention, a machine for relieving stress in a human comprises an elongate horizontal platform having a length and width sufficient to carry a horizontally reclining human body through a circular movement, said circular movement being in a vertical plane perpendicular to the longitudinal axis of said platform, and rotary drive means adapted to move the platform along a circular path. A mechanical linkage connected to the platform holds the platform so that its directional orientation stays the same as it movees along the circular path. Unlike the earlier known apparatus, the machine has no electrodes or generator for producing an electric field in the region of the transport means. The mechanical linkage comprises four parallel elongate members of equal length connecting the rotary drive means to the platform. These members are rigidly connected to the platform at spaced apart locations.

A second preferred embodiment of the machine has a supportive surface that is adapted to carry a sitting human body and that includes a back rest. In this embodiment, the circular path followed by the transport means is in a horizontal plane. The mechanical linkage includes two pairs of elongate members with the members in each pair being parallel and connected pivotally to a joint member. One pair of the elongate members is pivotally connected to the chair or transport means while the other pair is pivotally connected to a fixed support such as a wall.

According to another aspect of the invention, a machine for relieving stress comprises chair means to support and carry a human body in a sitting position and rotary drive means connected to the chair means to move the chair means along a circular path extending about a vertical axis. A mechanical linkage is connected to the chair means and to a fixed support and is adapted to hold the chair means so that it maintains the same directional orientation during operation of the drive means.

Both treatment machines disclosed herein can be used in conjunction with a low energy electric field in a manner similar to that disclosed in my U.S. Pat. No. 4,256,095 if desired.

Also according to the invention, a method for relieving stress in a human body comprises placing the body of a patient on a supportive surface so that the longitudinal axis formed by the head and back of said human body extends in a predetermined direction, transporting the supportive surface together with the body along a circular path extending about an axis parallel to said longitudinal axis of the body, and simultaneously holding the supportive surface so that the directional orientation of the body and the surface remains the same as the supportive surface and body are moved along the path. Again unlike the earlier known method, the present method is carried out in the absence of an electric field.

With the use of the method and machine disclosed herein, the patient or subject does not become nauseous or dizzy and the patient can be treated for sessions as long as one hour. The machines disclosed herein can be operated at reasonably low speeds but still be effective. When they operate at low speeds, it is not necessary to strap the subject in normally.

BRIEF DESCRIPTION OF THE DRAWINGS

Other features and advantages will be apparent from the following detailed description of preferred embodiments taken in conjunction with the accompanying drawngs wherein.

DETAILED DESCRIPTION OF PREFERRED EMBODIMENTS

Figure 1:
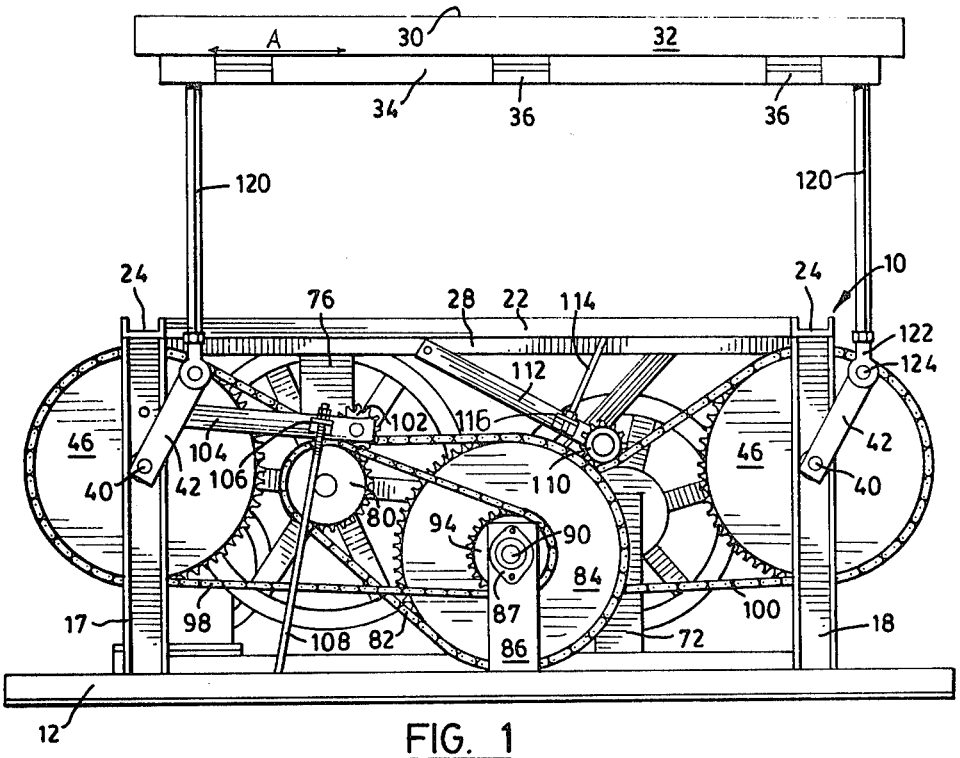
FIG. 1 is a front elevation of a first embodiment of a machine constructed in accordance with the invention.

Referring to drawings 1 to 4, there is shown a first embodiment of a machine 10 for relieving stress in a human being. The machine rests on a steel framework comprising two long angle members 12 that extend lengthwise and two shorter channel members 14 and 16 that extend between the members 12. The web of the channel members 14 and 16 is disposed upwardly. The channel members are located a short distance inwards from the ends of the longitudinally extending members 12. Extending upwardly from the base frame are four upright posts 17 to 20, which posts are also made from channel members. In order to form a very rigid box frame in which to mount the drive parts, each pair of posts 17 and 18, 19 and 20 is connected together at the top by means of a longitudinal angle member 22. Furthermore each pair of posts 18 and 19, 17 and 20 is connected together at the top by means of a channel member 24. These angle and channel members are connected together by welding preferably. As clearly shown in FIG. 4, there are two further channel members 26 and 28 that extend in a longitudinal direction. The lower member 26 is connected at each end to a respective transverse channel member 14 or 16. The upper channel member 28 is located directly above the channel member 26 and is connected at each end to the lower surface of one of the channel members 24.

Figure 2:
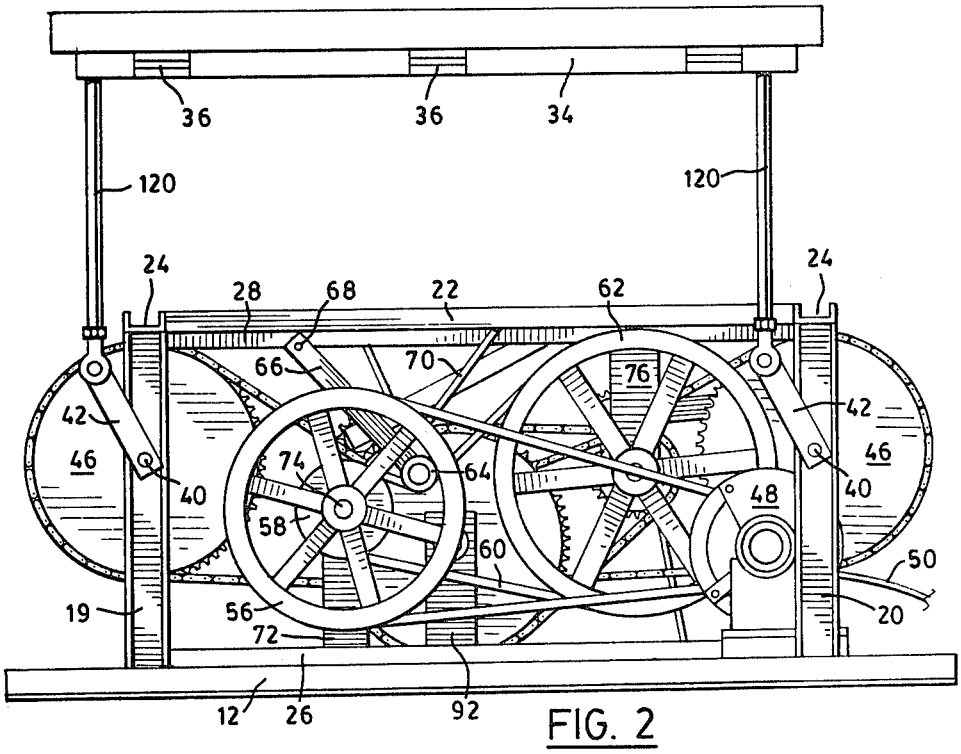
FIG. 2 is a rear elevation of the embodiment shown in FIG. 1.

The machine 10 has transport means with a supportive surface 30 adapted to carry a human body through a circular movement. In this embodiment the transport means comprises an elongate platform 32 adapted to carry a reclining human body. In other words a person can lie flat on this platform and be fully supported from his head to his feet. The platform can be covered with suitable padding so that it is comfortable to lie on. The platform 32 includes a rigid rectangular frame made of angle members welded together. There are two parallel members 34 that are shown in FIG. 1 and two other members 35 connecting the ends of the members 34. For purposes of illustration, the upper padded portion of the platform is not shown in FIG. 2. In this figure the padded portion has been removed and only the member 34 on one side can be seen. To each of these members, there are fastened three brackets 36, each of which has a hole to receive a bolt for connecting the padded upper portion. Further suitable connectors can be provided along the members 35 as well, if desired.

Figure 4:
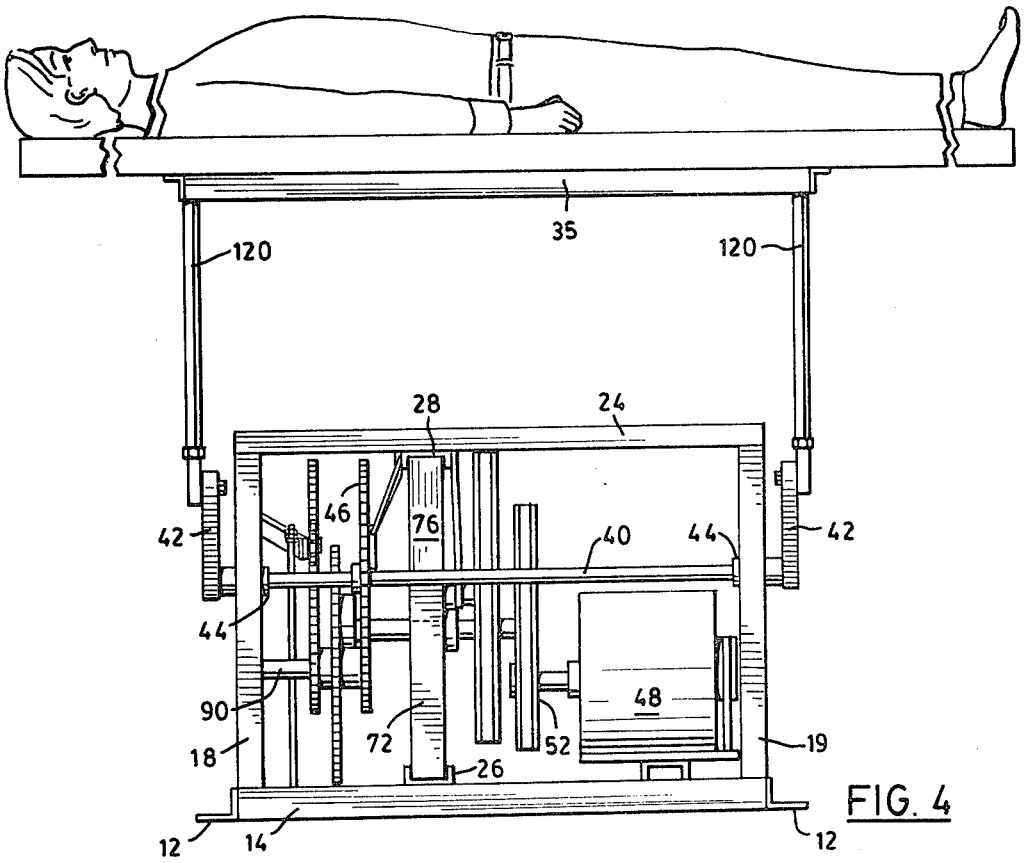
FIG. 4 is an end elevation of the same embodiment.

A rotary drive mechanism is provided to move the above described transport means along a circular path. In this embodiment the rotary drive means includes two rotatable horizontal shafts 40. Each of the shafts and the parts mounted thereon are constructed in a similar fashion so only the right hand shaft and related parts will be described. The right shaft 40 is shown clearly in FIG. 4 of the drawings. It will be noted that the posts 18 and 19 provide support means for holding this shaft at an elevated position above the ground level. Connected to each end of the shaft is a rigid arm 42 which rotates with the shaft. Each arm extends in a direction perpendicular to the shaft and moreover the four arms mounted on the two shafts all extend in the same direction at all times. A suitable bearing 44 is mounted on each post to rotatably support the shaft which extends through the post. Fixedly mounted on each shaft 40 is a large sprocket 46. As shown in FIG. 4 the sprocket 46 is located approximately midway between the middle of the shaft and the front end thereof. The sprocket 46 on the left hand shaft 40 is positioned even closer to the front of the machine.

Figure 3:
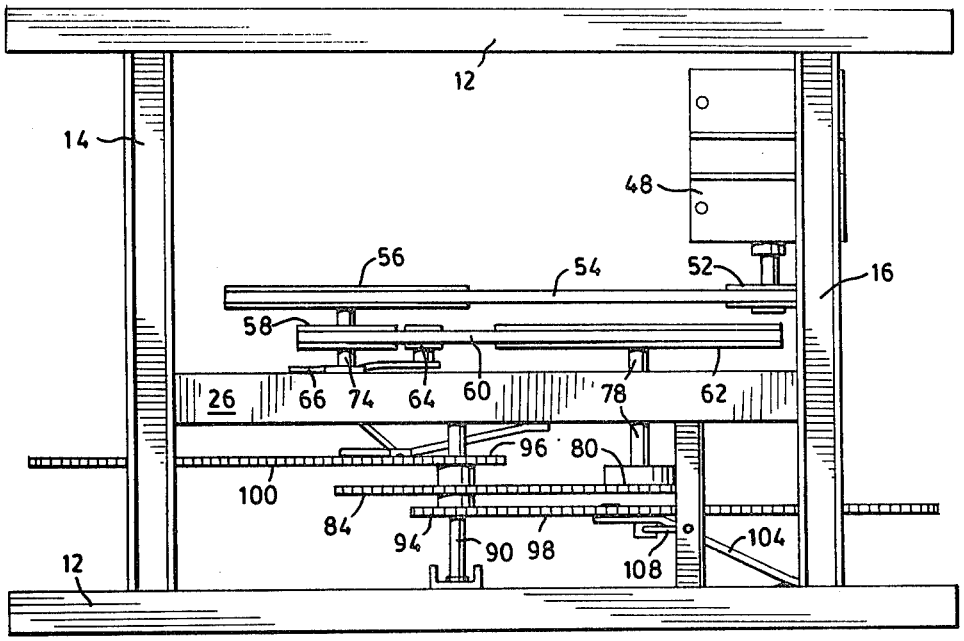
FIG. 3 is a bottom view of the same embodiment.

The rotary drive means includes motor means for rotating the two shafts at the same speed. Preferably an electric motor 48 drives the two sprockets 46 by means of a series of pulleys, connecting belts, a further sprocket and connecting chains. The interconnecting pulleys and sprockets provide a means for reducing the high rotational speed of the motor to a rotational speed that is suitable for the rotation of the transport means. The motor is connected to a power source through a suitable power cord 50. The motor drives a small pulley 52 shown in FIG. 3. This pulley rotates a belt 54 that extends around a much larger pulley 56. The pulley 56 is mounted on the same shaft as a smaller pulley 58 and rotates therewith. The pulley 58 drives a belt 60 that extends around a pulley 62 that is even larger than the pulley 56. An adjustment mechanism is provided to keep the tension in the pulley 6 at the correct amount. The adjustment mechanism includes a small pulley 64 mounted on an arm 66. The arm 66 is connected by means of a bolt at 68 to the channel member 28. Connected to the arm 66 at a position slightly above the pulley 64 is a threaded rod 70 which is also connected at its upper end to the member 28. By means of an adjustment nut near the bottom end of the rod 70 the arm 66 can be pivoted to some extent about the bolt at 68. In this way the tension in the belt 60 can be adjusted.

The second largest pulley 56 is rotatably mounted on a short, vertically extending post 72 that is connected at the bottom to the channel member 26. The side of the post can be seen in FIG. 4. A short shaft 74 is rotatably mounted in two bearings in the top of the post 72. Both pulleys 56 and 58 are mounted on the shaft 74. The largest pulley 62 is mounted at the bottom of a vertically extending frame member 76. The top of the frame member 76 is welded to channel member 28. Again a short shaft 78 is rotatably mounted in two bearings at the bottom of the member 76. At one end of the shaft 78 is mounted the large pulley 62 while at the other end there is a small diameter sprocket 80 shown clearly in FIG. 1. Rotation of the pulley 62 causes the corresponding rotation of the sprocket 80.

The mechanism for rotating the two large sprockets 46 at the same speed with the above mentioned electric motor and pulleys will now be described with particular reference to FIG. 1 of the drawings. The small sprocket 80 connected to the large pulley 62 is coupled via a drive chain 82 to a much larger sprocket 84. In fact the sprocket 84 can be the same size as the two sprockets 46 mounted on the shafts 40. The sprocket 84 is mounted at the top of a short vertical post 86. The post 86 is welded to the side of the front angle member 12. A suitable bearing 87 is mounted near the top of the post 86 to rotatably support a short shaft 90. The sprocket 84 is mounted to rotate with the shaft 90. The shaft 90 at its rear end is rotatably supported by means of a suitable bearing mounted at the top of a further short post 92 shown in FIG. 2. This short post is rigidly connected to the channel member 26. There are two smaller sprockets 94, 96 mounted on opposite sides of the sprocket 84. Both of the smaller sprockets rotate with the large sprocket 84. The sprocket 94 is coupled via a drive chain 98 to the sprocket 46 on the left side of FIG. 1. The small sprocket 96 is coupled via a drive chain 100 to the sprocket 46 on the right side of FIG. 1. Because sprockets 94 and 96 are of equal size and must rotate at the same speed, it will be appreciated that the sprockets 46 must also rotate at the same speed, a speed which will be considerably slower than the speed of rotation of the sprockets 94 and 96.

In order for the platform 32 to rotate at a smooth and uniform rate, the drive chains 98 and 100 must be maintained at a sufficient degree of tension. Accordingly chain tension adjustment means are provided and these can be seen in FIG. 1. The drive chain 98 is engaged along its top run by a small sprocket 102 which is rotatably mounted at the end of an adjustment arm 104. One end of the arm 104 is pivotally mounted to the post 17. Attached to the front side of the arm near the sprocket 102 is a bracket 106. The bracket has a hole to receive the top end of a rod 108. The bottom end of this rod is firmly attached to a frame member (not shown) extending between the front angle member 12 and the channel member 26. By adjusting two nuts at the top end of the rod 108, the arm 104 is pulled downwardly to increase chain tension. A similar arrangement is provided for the drive chain 100. In this case a small sprocket 110 is mounted on the end of an arm 112 which in turn is pivotally connected to the upper channel member 28. A threaded rod 114 is also mounted on the channel member 28 at its upper end. The lower end of the rod extends through a bracket 116 mounted on the front surface of the arm 112. By means of an adjustment nut on the rod 114 located on top of the bracket 116, one can increase the tension in the chain 100.

A mechanical linkage is connected to the transport means and is adapted to hold the transport means so that its directional orientation stays the same as it moves along the circular path. In the embodiment illustrated in FIGS. 1 to 4, this mechanical linkage includes four parallel elongate members which, as illustrated, comprise shafts 120. These shafts are of equal length and are rigidly connected to respective corners of the rigid rectangular frame formed by angle members 34 and 35. The bottom end of each shaft is provided with a connector 122 in which is mounted a bearing that rotatably receives a stub shaft 124. The stub shaft is rigidly mounted in the end of the arm 42 opposite the shaft 40. Because of the manner in which the shafts 120 are mounted, it will be appreciated that the platform 32 remains horizontal at all times and all rotational positions of the shafts 40. Accordingly the upper surface of the transport means always faces upwardly. In addition the longitudinal direction of the transport means indicated by the arrow A never changes in direction during operation of the machine. Only a change in the orientation of the base of the machine would cause a change in the orientation of the transport means.

The longitudinal axis of the platform 32 supporting the subject is parallel to the members 35, one of which is shown in FIG. 4. The subject lays on the platform always in the direction shown in FIG. 4. In this position the longitudinal axis formed by the head and back of the subject is perpendicular to the vertical plane through which the circular motion occurs. In other words the longitudinal axis of the subject laying on the platform should always be parallel to the members 35.

It will be appreciated that the platform 32 is long enough and wide enough for a person to lie flat on and because the platform does not rotate at a high rate of speed, no safety straps are normally necessary. It should also be noted that this machine has no electrodes or generator to produce an electric field in the region of the platform. It has been found that such an electric field is not required in order to induce relaxation and to relieve stress. The speed of rotation is not critical but should not be less than one revolution per minute. Good results can be obtained with rotational speeds of up to thirty revolutions per minute. If the rotational speed is excessive, the subject may feel uncomfortable and often dizzy, and a slight jerk in the motion could result at the apogee of the rotational movement of the platform. Since no electric field is used, there is no shock hazard and no need for government regulations covering the use of this machine.

Figure 5:
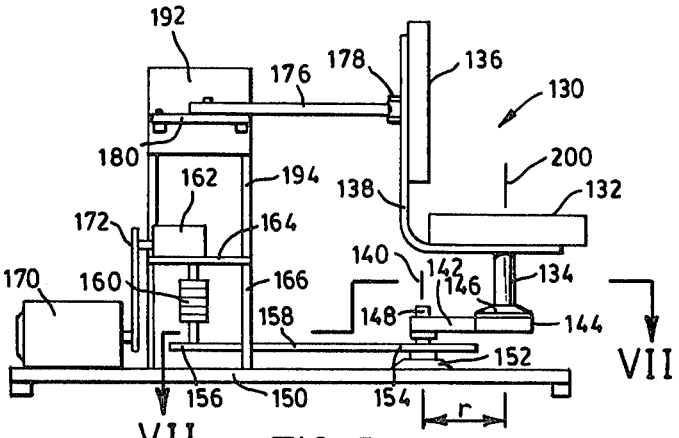
FIG. 5 is a front elevation of a second embodiment constructed in accordance with the invention.
Figure 6:
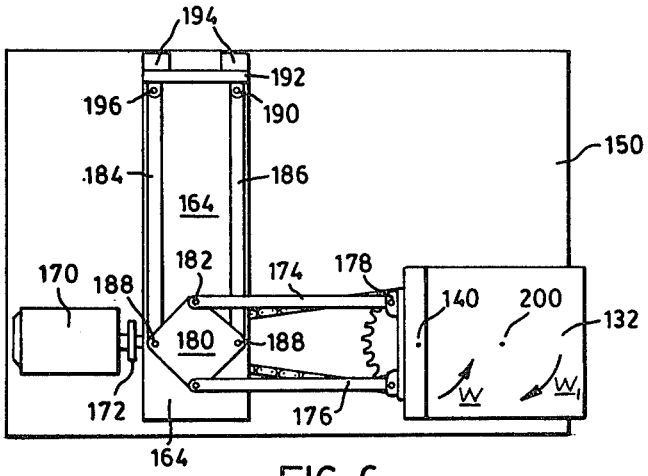
FIG. 6 is a top view of the embodiment shown in FIG. 5.
Figure 7:
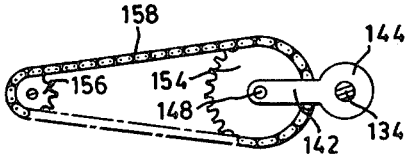
FIG. 7 is a detailed view taken along the line VII—VII as shown in FIG. 5.

Turning now to the second embodiment shown in FIGS. 5 to 7 of the drawings, this embodiment is indicated generally by the reference 130. In this embodiment the transport means has a supportive surface adapted to carry a sitting human body. In fact the transport means comprises a chair 132 mounted on a pedestal or shaft 134 and having a back rest 136. A steel strip 138 bent in the form of a L can be used to connect the horizontal seat portion to the back rest.

As in the first embodiment, rotary drive means are provided to move the chair along a circular path but in the present embodiment the circular path is in a horizontal plane. The chair rotates about a vertical axis indicated at 140. The rotary drive means includes a horizontal arm 142 with a circular end portion 144. Rotatably mounted in the circular end portion is the shaft 134. A suitable bearing 146 can be mounted on top of the portion 144 to permit free and easy rotation of the shaft 134. A short drive shaft is provided at 148 and this shaft extends through the base 150 of the machine and through one end of the arm 142. A support bearing 152 is mounted on the base 150 to permit easy rotation of the shaft. A large sprocket 154 is also mounted on the shaft 148. This sprocket is driven by a smaller sprocket 156 through a drive chain 158. The details of this drive mechanism are shown in FIG. 7. The drive sprocket 156 is connected to a coupler 160 of a speed reducer 162. In the illustrated embodiment the reducer 162 is mounted on a platform 164 that is supported on rigid tubular legs 166. A motor 170 drives the reducer using a belt and pulley arrangement 172.

A mechanical linkage connected to the chair holds the chair so that its directional orientation stays the same as the chair moves along the circular path. In this embodiment this linkage includes two pairs of rigid elongate members with the members in each pair being parallel. One pair of elongate members 174 and 176 is pivotally connected to the back rest 136 of the chair. Two connecting brackets 178 are rigidly mounted on the back rest for this purpose. Pins extend through these brackets and through holes in the ends of members 174 and 176. The opposite ends of this pair of members are pivotally connected to a joint member 180 which can be in the form of a flat, rigid plate. As illustrated, these elongate members are connected to the top of the joint member 180 by means of pins 182. It will be appreciated that because the distance between the pins 182 equals the distance between the pins extending through the brackets 178 and because the members 174 and 176 are of equal length, the elongate members will always be parallel to one another no matter what position is assumed by the chair. The other pair of elongate members 184 and 186 are also pivotally connected to the joint member 180 by means of connecting pins 188. The other ends of these members are pivotally connected by means of two brackets 190 to a fixed support 192. In the illustrated embodiment this support comprises a rigid vertical plate mounted at the top of two steel posts 194.

The base of each post is rigidly fastened to the base 150. It will be appreciated that if the machine is to be a permanent installation located at a specific location in a building, the base 150 could be replaced by a floor and the plate 192 could be replaced by a wall in the building. Again because the distance between the pins 196 mounted in the brackets 190 is the same as the distance between the pins 188 and because the members 184 and 186 are equal in length, these two members will always be parallel to each other. It will be readily seen that because the two pairs of elongate members form parallelogram linkages, the directional orientation of the chair remains the same as it moves along the circular path around the axis 140.

The motion of the chair will now be explained in greater detail. As indicated by the arrow in FIG. 6, the chair is rotated about the vertical axis at 140 with a primary angular velocity W. The radius of rotation is indicated by the distance r in FIG. 5. At the same time as the chair is being moved in this manner, the chair is also being rotated about the central axis 200 extending through the vertical shaft 134. The speed and direction of the rotation about the axis 200 is indicated by the arrow $w_1$ in FIG. 6. Because $W_1$ equals $-W$ the directional orientation of the chair stays the same at all times. The motion of the platform 32 in the first embodiment can be explained in essentially the same manner.

It will be apparent to those skilled in the art that various modifications and changes to the described machine could be made by one skilled in the present art without departing from the true spirit and scope of the invention. For example, in place of at least some of the pulleys, drive belts and sprockets used in the first embodiment, one could readily substitute a suitable gear reducer and/or gears. A gear reducer may reduce the amount of space required but may result in a more expensive machine. Other possible changes will be readily apparent. Thus the embodiments described herein are not to be taken as indicative of the limits of the invention but rather as exemplary structures of the invention which is defined by the claims appended hereto.

What I claim as my invention is:

1. A machine for relieving stress in a human comprising:

an elongate horizontal platform having a length and width sufficient to carry a horizontally reclining human body through a circular movement, said circular movement being in a vertical plane perpendicular to the longitudinal axis of said platform;

rotary drive means adapted to move said platform along a circular path; and a mechanical linkage connected to said platform and adapted to hold said platform so that its directional orientation stays the same as said platform moves along said circular path, said mechanical linkage including four parallel elongate members of equal length connecting said rotary drive means to said platform, said elongate members being rigidly connected to said platform at spaced apart locations;

wherein said machine has no electrode or generator means for producing an electric field in the region of said platform.

2. A machine according to claim 1 wherein said rotary drive means comprises two rotatable horizontal shafts, support means for holding said shafts at an elevated position, two arms fixedly connected to opposite ends of each shaft and extending perpendicular to the shaft, each of the four arms extending in the same direction as the other arms at all times, and motor means for rotating said two shafts at the same speed, and wherein said mechanical linkage is pivotally connected to the ends of said arms furthest from the respective shafts.

3. A machine for treating a human comprising:

an elongate horizontal platform having a length and width sufficient to carry a horizontally reclining human body through a circular movement, said circular movement being in a vertical plane perpendicular to the longitudinal axis of said platform;

rotary drive means adapted to move said platform along a circular path, said rotary drive means comprising two rotatable horizontal shafts, support means for holding said shafts at an elevated position, two arms fixedly connected to opposite ends of each shaft and extending perpendicular to the shaft, each of the four arms extending in the same direction as the other arms at all times, and motor means for rotating said two shafts at the same speed; and a mechanical linkage connected to said platform and adapted to hold said platform so that its directional orientation stays the same as said platform moves along said circular path, said mechanical linkage being pivotally connected to the ends of said arms furthest from the respective shafts and including four parallel elongate members of equal length connecting said four arms to said platform means, said elongate members being rigidly connected to said platform.

* * * * *